US007481331B2

(12) United States Patent
Webster et al.

(10) Patent No.: US 7,481,331 B2
(45) Date of Patent: Jan. 27, 2009

(54) DISPENSING CONTAINER FOR A BLISTER PACK OF MEDICATIONS

(75) Inventors: John H. Webster, Winnipeg (CA); John L. Webster, Winnipeg (CA); Fiona Webster-Mourant, Winnipeg (CA)

(73) Assignee: Manrex Limited, Winnipeg, Manitoba (CA)

( * ) Notice: Subject to any disclaimer, the term of this patent is extended or adjusted under 35 U.S.C. 154(b) by 231 days.

(21) Appl. No.: 11/222,220

(22) Filed: Sep. 9, 2005

(65) Prior Publication Data

US 2007/0056982 A1 Mar. 15, 2007

(51) Int. Cl.
*A47F 1/04* (2006.01)

(52) U.S. Cl. ..... 221/307; 221/303; 221/255; 221/256; 221/257; 221/25; 221/26; 221/30

(58) Field of Classification Search ..... 221/1–312 C
See application file for complete search history.

(56) References Cited

U.S. PATENT DOCUMENTS

| | | | | | |
|---|---|---|---|---|---|
| 3,581,885 | A * | 6/1971 | Wald | 206/470 |
| 3,811,599 | A | 5/1974 | OConnor | |
| 4,502,612 | A * | 3/1985 | Morrison | 221/185 |
| D293,887 | S | 1/1988 | Webster | |
| D296,589 | S | 7/1988 | Webster | |
| 5,035,237 | A * | 7/1991 | Newell et al. | 128/203.15 |
| 5,038,968 | A * | 8/1991 | Albetski | 221/1 |
| 5,109,984 | A | 5/1992 | Romick | |
| 5,323,907 | A * | 6/1994 | Kalvelage | 206/531 |
| 5,348,158 | A | 9/1994 | Honan et al. | |
| 5,368,187 | A | 11/1994 | Poncetta et al. | |
| 5,791,513 | A * | 8/1998 | Intini | 221/30 |
| 5,988,429 | A * | 11/1999 | Coe | 221/25 |
| 6,318,051 | B1 | 11/2001 | Preiss | |
| 6,338,408 | B1 * | 1/2002 | Anderson | 206/538 |
| 6,540,081 | B2 * | 4/2003 | Balz et al. | 206/531 |
| 6,574,166 | B2 * | 6/2003 | Niemiec | 368/10 |
| 6,651,840 | B1 | 11/2003 | Van Dullemen et al. | |
| 7,328,801 | B2 * | 2/2008 | Iossi | 206/531 |
| 2003/0042167 | A1 * | 3/2003 | Balz et al. | 206/531 |

(Continued)

FOREIGN PATENT DOCUMENTS

| | | |
|---|---|---|
| CA | 1310936 | 12/1992 |

(Continued)

*Primary Examiner*—Gene Crawford
*Assistant Examiner*—Michael K Collins
(74) *Attorney, Agent, or Firm*—Adrian D. Battison; Ade & Company Inc.

(57) ABSTRACT

A wall mounted vertical, gravity fed dispensing container for use with a blister pack includes a pair of perforated sheets defining a holder portion for receiving and supporting the blister pack while holding the blister pack parallel to the wall. The holder portion is formed as a separate element which can be snapped into the container. The two sheets are hinged at the bottom. Behind the holder portion is a catching container fixed to the holder portion and to the wall such that medication expelled from the blisters through the openings by a manually movable punch is caught in the catching container. A bottom wall of the catching container converges the medications to a bottom chute with a manually movable press lever operating a flap valve to discharge the medications into a cup. A front door covers the holder and the blister pack and contains a receptacle for the punch.

15 Claims, 5 Drawing Sheets

U.S. PATENT DOCUMENTS

2004/0158350 A1* 8/2004 Ostergaard et al. ..... 700/231
2005/0082194 A1* 4/2005 Fry et al. ..... 206/531

FOREIGN PATENT DOCUMENTS

DE 38 38 144 5/1990
DE 3838144 A1 * 5/1990
DE 295 13 226 10/1995
JP 03 256876 11/1991
JP 03256876 A * 11/1991

* cited by examiner

DISPENSING CONTAINER FOR A BLISTER PACK OF MEDICATIONS

This invention relates to a vertically mounted, gravity fed dispensing container for containing a blister pack of medications by which the medications in the blister pack can be ejected from the blister pack for dispensing to a patient, or, for self administration.

BACKGROUND OF THE INVENTION

Medications are commonly delivered in what are known as "blister packs" in which medications are placed in a series of blisters and then sealed on the other side by a foil layer. The medications are thus maintained in properly supported position in a hygienic manner in the individual blisters and held in place by the foil layer. In some, but not all cases, support is provided by a cardboard backing/overlay, formed of card which can then include printed information or other written information which identifies the medication and/or the patient.

Various designs and arrangements of such blister packs have previously been proposed including the different shaping of the openings and therefore of the blisters to provide particular effects. In particular Canadian Patent 1,310,936 assigned to the present applicant there is disclosed a blister pack of this type in which the openings are arranged in a matrix of seven rows and four columns providing four blisters each of which can be used for a respective day of the week with four medication administration times as defined by the rows, or, by four weeks of seven days for a single specific medication administration time. Thus a patient taking medications four times a day can be supplied with a blister pack of this type in which the medications for each time of day and for each day of the week are set out in the individual blisters.

Further details of this arrangement are shown in the above Canadian Patent issued Dec. 1, 1992, the disclosure of which is incorporated herein by reference.

Other arrangements are shown for example in U.S. design Pat. Nos. D296589 issued Jul. 5, 1988 and D293887 issued Jan. 26, 1988.

Blister packs of this type therefore make the medications properly available to the patient so that the patient can be ensured that they have taken the proper medications at the proper time. Reminders can be provided and the patient will be readily aware if a medication has been omitted since the medications not taken will remain in the blister pack.

As shown in the above Canadian patent, the dimensions of the individual blisters have been modified to provide larger blisters at certain times of day and smaller blisters at other times of day depending upon volume of medication commonly taken at those times.

A critical issue, however, is proper storage and convenient placement of the blister packs to ensure the medications are taken and not forgotten remains an open problem in that they merely may be discarded within the patients home. By not being stored in a consistent location or by being placed in an inconvenient location, or readily supported for the convenience of the patient or for the convenience of a caregiver looking after the patient may lead to medication non-compliance and a serious and potentially dangerous situation.

In addition, poor or improper storage may lead to medication degradation, or provide easy access for individuals not intended for the medications.

A number of different designs have been proposed of devices for holding blister packs and/or expelling of medications from blister packs.

In U.S. Pat. No. 5,109,984 (Romick) issued May 5, 1992 is disclosed a holder for blister packs with two overlying sheets between which the blister pack is retained with each sheet having opening aligned with the blisters by which the medications can be expelled though the openings. A cover extends over one of the sheets.

In U.S. Pat. No. 6,651,840 (Van Dulleman) issued Nov. 25, 2003 is disclosed a holder for a blister pack where the blister pack is annular and the holder defines a housing surrounding the outside of the blister pack with a dispensing plunger inside the annulus of the blister pack to expel the medications outwardly though an opening in the outer housing so that the medication when expelled from the blister falls directly through the opening. The plunger and opening are rotated relative to the blister pack to select one of the blisters for expulsion of the medication.

In U.S. Pat. No. 5,348,158 (Honan) issued Sep. 20, 1994 is disclosed a holder for a blister pack where the blister pack is rectangular and the holder defines a corresponding shaped housing with a-top and bottom and with a dispensing plunger at the top of the blister pack to expel the medications downwardly though the bottom so that the medication when expelled from the blister falls directly through a bottom opening. The plunger is movable along an S-shaped track across the top of the housing to interact with each blister in turn.

In U.S. Pat. No. 5,368,187 (Poncetta) issued Nov. 29, 1994 is disclosed a dispenser for simultaneously dispensing medications from a stack of parallel, horizontal, overlying blister packs where a dispensing plunger with a cutter at the top of the blister pack stack is driven downwardly through an aligned column of the blisters of stack to expel the medications downwardly into a bottom container.

In U.S. Pat. No. 6,318,051 (Preiss) issued Nov. 20, 2001 is disclosed an automated system for expelling medications from blister packs using a vertically movable plunger which pushes downwardly through the blister pack to expel the medication into a tray below the blister pack.

SUMMARY OF THE INVENTION

It is one object of the invention to provide a dispensing container for holding blister packs of medications which assist the user in conveniently storing the blister pack and dispensing the medications therefrom.

According to one aspect of the invention there is provided a dispensing container for use with a blister pack having a series of blisters each containing a dose of one or more medications which can be expelled from the blisters by a user for use of the medication, the dispensing container comprising:

a holder portion for receiving and supporting the blister pack;

the holder portion having a plurality of openings therein arranged to be aligned with the blisters in the blister pack such that the medication in each blister can be expelled from the blister through the opening;

a catching container fixed to the holder portion adjacent the holder portion such that medication expelled from the blisters through the openings is caught and held in the catching container;

and a dispensing opening in the catching container arranged such that the medication caught and held in the catching container can be discharged by the user from the catching container through the dispensing opening when required;

the dispensing opening and the catching container being arranged such that the medication is held in the catching container until the user releases the medication from the dispensing opening.

The user may be the patient themselves or may be a caregiver either in a home setting or in an institution.

Preferably the catching container is shaped to converge the medications from each of the blisters to the dispensing opening.

Preferably the dispensing opening includes a discharge chute for collecting the medications from the catching container.

Preferably the discharge opening includes a valve operable by the user to release the medications from the discharge opening after they have been expelled from the blister and collected in the catching container.

Preferably the valve comprises a hinged flap which may be actuated by the valve including a push lever operable by the user to open the valve.

In a particularly preferred arrangement, the container includes a wall mounting arrangement arranged such that with the dispensing container mounted on a vertical wall surface the holder portion mounts the blister pack vertically with the catching container behind the blister pack and the dispensing opening at a bottom wall of the catching container. However other mountings may be used or the container may be free standing.

Preferably in this arrangement, the wall mounting arrangement is attached on a rear face of the catching container.

Preferably the wall mounting arrangement comprises a magnet for attachment to a metal surface and holes for attachment to mounting screws.

Preferably the holder portion comprises a separate piece from the catching container which is arranged to snap onto the catching container.

Preferably the holder portion comprises two generally planar sheets for receiving the blister pack therebetween which are connected by a hinge at a bottom edge.

Preferably there is provided a front door panel hingedly attached to the catching container which can be moved from a closed position covering the holder portion to an open position exposing the holder portion and the blister-pack thereon.

Preferably a front face of the door panel has a photograph holder.

Preferably there is provided a punch having a front face shaped to match the openings in the holder portion for punching out the medications from the blisters, the punch having a manually graspable handle for manual movement of the punch to a selected one of the blisters and a support on the dispensing container to hold the punch on the dispensing container when not in use.

Preferably the support comprises a receptacle into which the punch is placed.

According to a second aspect of the invention there is provided a dispensing container for use with a blister pack having a series of blisters each containing a dose of one or more medications which can be expelled from the blisters by a user for use of the medication, the dispensing container comprising:

a holder portion for receiving and supporting the blister pack;

the holder portion having a plurality of openings therein arranged to be aligned with the blisters in the blister pack such that the medication in each blister can be expelled from the blister through the opening;

a catching container adjacent the holder portion such that medication expelled from the blisters through the openings is caught and held in the catching container;

a dispensing opening in the catching container arranged such that the medication caught and held in the catching container can be discharged by the user from the catching container through the dispensing opening when required;

and a wall mounting arrangement arranged such that with the dispensing container mounted on a vertical wall surface the holder portion mounts the blister pack vertically with the catching container behind the blister pack and the dispensing opening at a bottom wall of the catching container.

Preferably in the above aspect the discharge opening includes a valve operable by the user to release the medications from the discharge opening.

According to a third aspect of the invention there is provided a dispensing container for use with a blister pack having a series of blisters each containing a dose of one or more medications which can be expelled from the blisters by a user for use of the medication, the dispensing container comprising:

a holder portion for receiving and supporting the blister pack;

the holder portion having a plurality of openings therein arranged to be aligned with the blisters in the blister pack such that the medication in each blister can be expelled from the blister through the opening;

a catching container adjacent the holder portion such that medication expelled from the blisters through the openings is caught and held in the catching container;

a dispensing opening in the catching container arranged such that the medication caught and held in the catching container can be discharged by the user from the catching container through the dispensing opening when required;

and a punch having a front face shaped to match the openings in the holder portion for punching out the medications from the blisters, the punch having a manually graspable handle for manual movement of the punch to a selected one of the blisters and a support on the dispensing container to hold the punch on the dispensing container when not in use.

Preferably in the above aspect the support comprises a receptacle into which the punch is placed.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
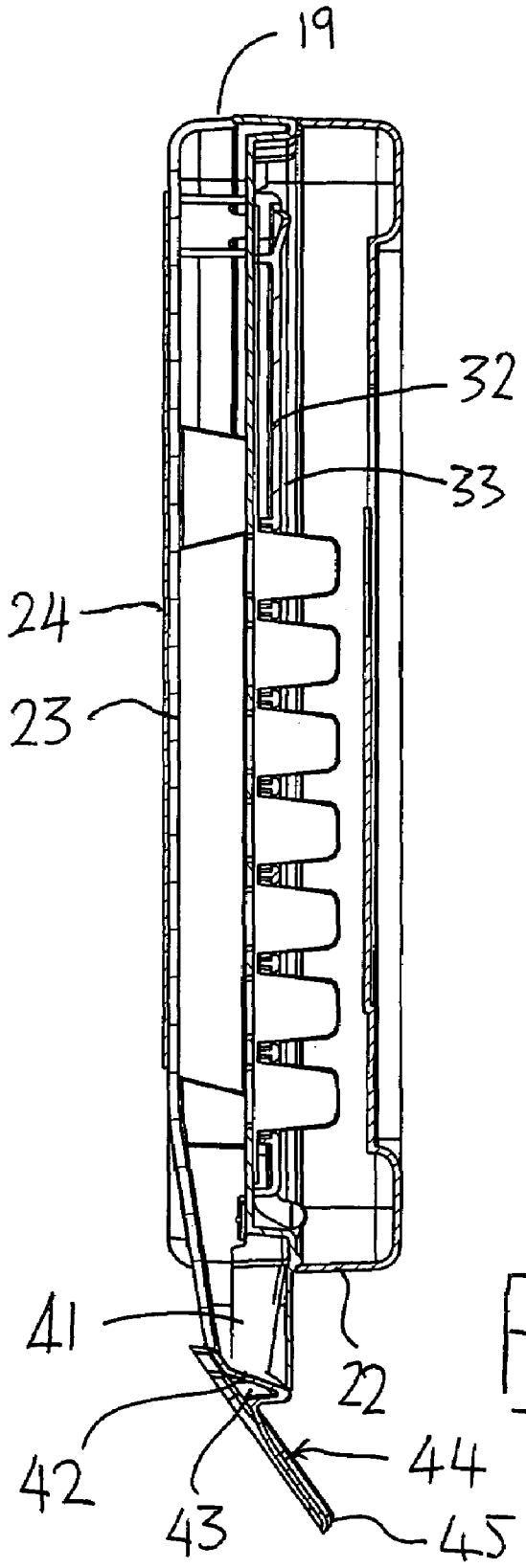
FIG. 1 is a cross sectional view of a dispensing container according to the present invention showing the container in the closed position.
Figure 4:
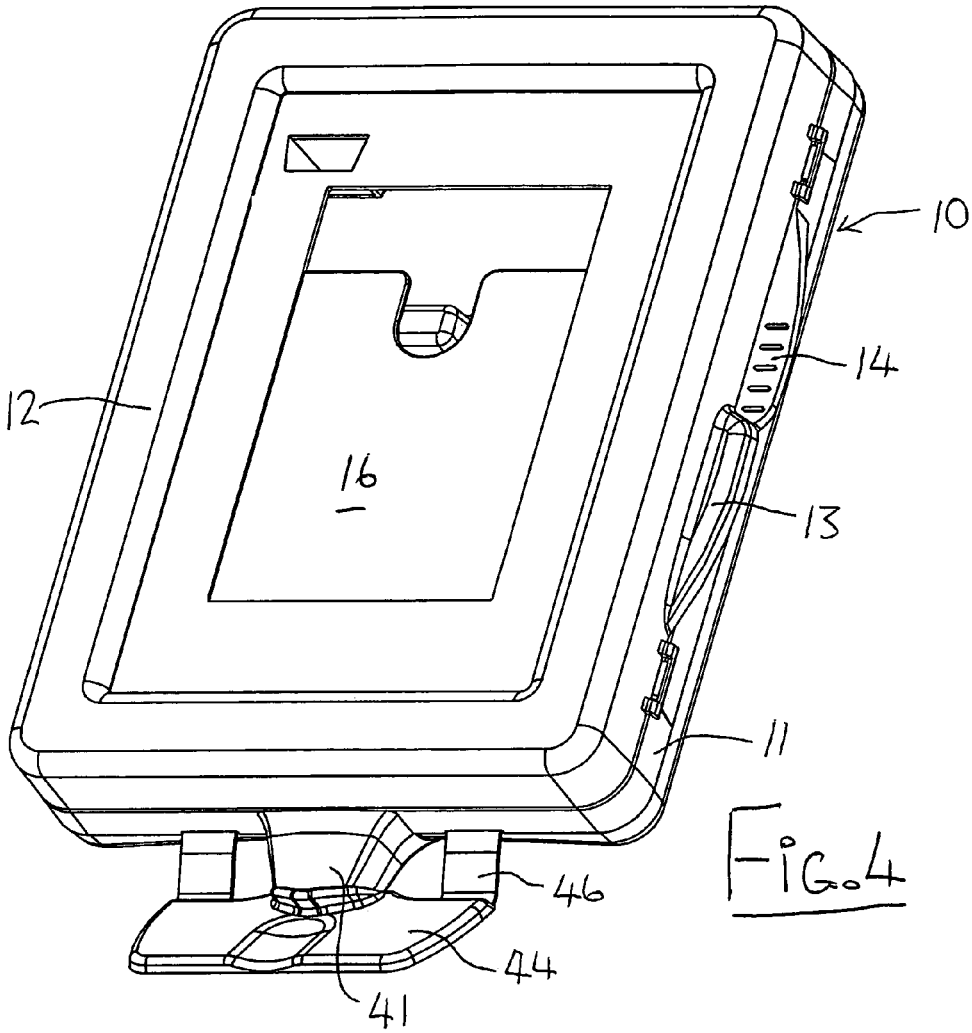
FIG. 4 is an isometric view of the container of FIGS. 1, 2 and 3 showing the container in closed position.
Figure 5:
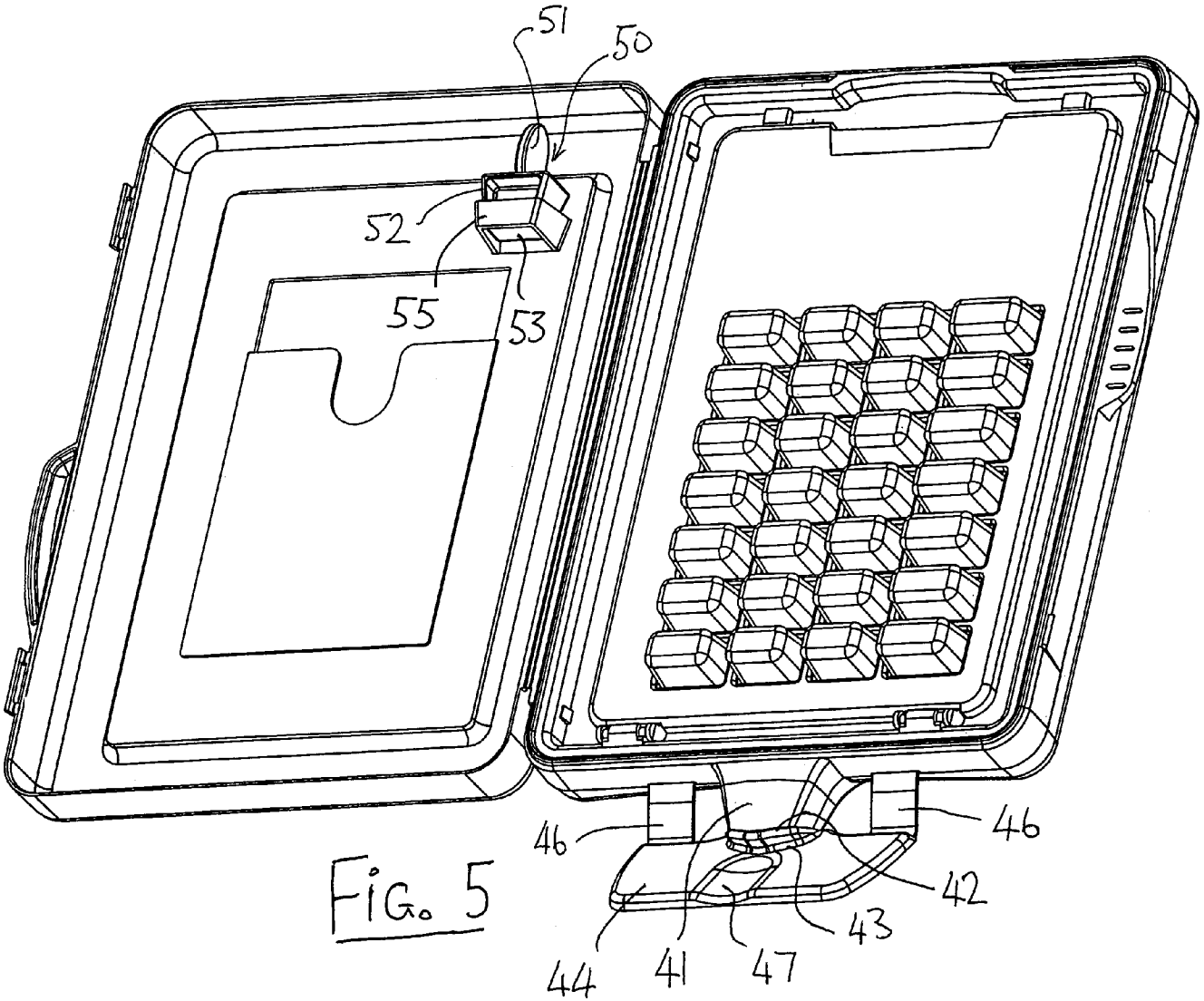
FIG. 5 is an isometric view similar to that of FIG. 4 showing the container in the open condition.

The container shown in the figures comprises a rear container portion 10 defining a chamber 11 covered by a hinged front door 12. The hinged front door is mounted on side hinges 15 allowing it to be pivoted about a vertical axis along one side of the container from an open position shown in FIG. 2 and FIG. 5 to a closed position shown in FIGS. 1 and 4. The container portion 10 with the door 12 is formed as an integrally molded element using conventionally known techniques so that the hinges 15 are integrally formed and provide sufficient flexibility to allow the door to pivot about the vertical axis. A snap fastener 14 is provided on the container portion which cooperates with a corresponding portion 13 on the door so that door can be closed and snapped into place in the closed position.

The front surface of the door carries a holder 16 into which a photograph or other picture can be inserted for holding on the front face to provide an attractive appearance for the container. It will be appreciated that persons using a device of this type tend to be elderly and therefore the device can be turned into a personalized holder so as to reduce its utilitarian or institutional appearance. In the alternative, the holder 16 can be used for patient data printed on a suitable substrate.

Figure 2:
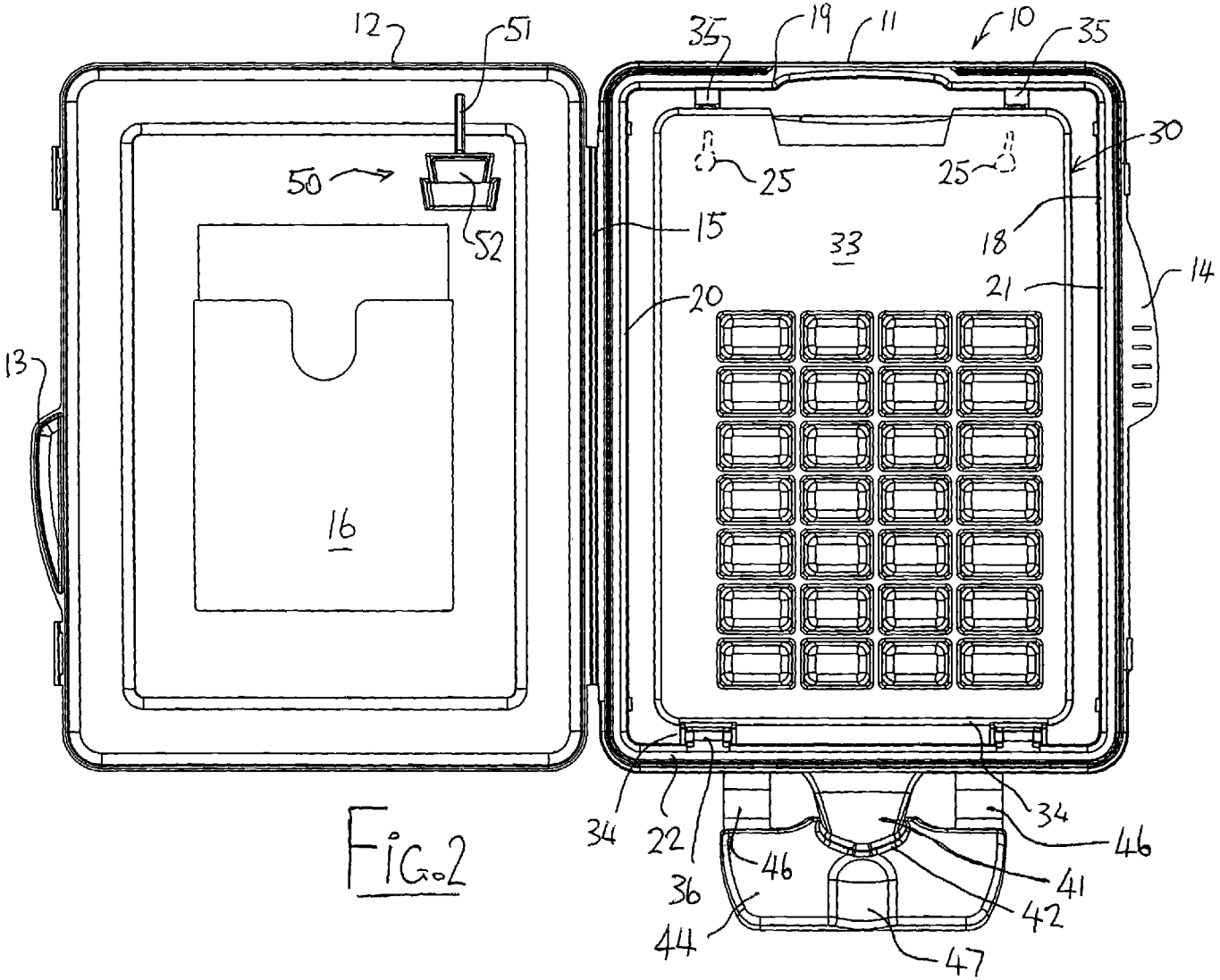
FIG. 2 is a front elevational view of the dispensing container of FIG. 1 showing the container in an opened position for use by the patient or caregiver.

The container portion 11 as best shown in FIG. 2 defines a rectangular open face 18 forming a top wall 19 and two side walls 20 and 21 together with a bottom wall 22. The walls extends forwardly from a flat back face 23 to define a rectangular chamber which is covered in the closed position by the hinged door. The flat back wall 23 carries a magnetic sheet 24 which is adhesively attached to the rear surface of the back wall 23 so that the container can be readily attached to a metal wall such a refrigerator.

The rear wall 23 can also be attached to other suitable vertical support surfaces for example by double sided adhesive tape. In a further alternative, the rear wall has key hole slots 25 exposed on the rear surface so that screws can be inserted through the key hole slots allowing the container to be suspended on a wall of the type which can readily receive such screws. The unit also comes with an attached magnetic sheet on the back of the unit which allows the unit to be mounted on a metal fridge.

In this way, the whole container can be mounted readily on a vertical support surface with the front wall of the hinged door presented forwardly with the holder 16 thereon.

A separate blister holder 30 is provided which can support a blister pack 31 of the type previously described.

The blister holder 30 includes a first support sheet 32 and a second support sheet 33 with the support sheets being hinged at two bottom horizontal hinge pins 34. The sheet 32 is moulded from a first stiffer plastics material to provide the strength of the structure and the second or front sheet 33 is formed of a transparent plastics material. Each piece includes an integrally moulded hinge element connected by the hinge pin so that the sheets provide sufficient stiffness to be self supporting and the hinge allows the second sheet 33 to be hinged downwardly as shown in FIG. 3 to open up a space between the two sheets.

The sheet 32 is rectangular so as to fit into the rectangular opening 20 in the container portion. The container portion includes suitable snap holders 35 at the top and flanges 36 at the bottom which cooperate with the hinges 34 so that the first sheet 32 can be snapped into place and held in place by the snap fasteners as an exposed wall within the container portion 11.

The blister sheet 31 is a separate element from the blister sheet holder and comprises a foil layer 31B and a blister sheet 31C. Blister packs of this type are of course well known as described above. The blister sheet may include a stiffening card but these are optional and one is not shown in the figures.

Figure 3:
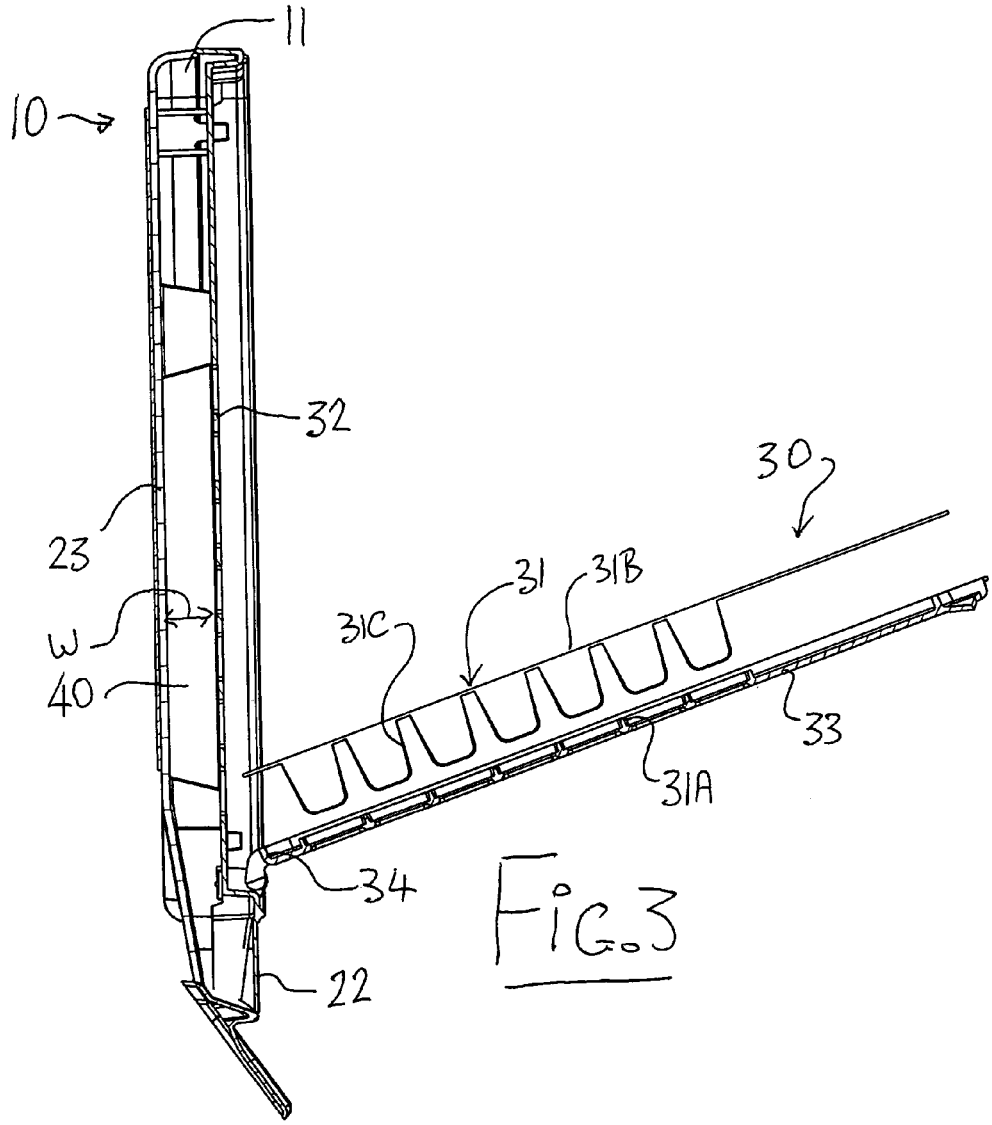
FIG. 3 is a cross sectional view similar to that of FIG. 1 showing the container mounted on a wall surface with the container opened and the holding portion opened for receiving the blister pack.

With the front sheet 33 hinged downwardly as shown in FIG. 3, the blister pack can be dropped into the openings in the front sheet so that the blisters project through the front sheet and are exposed on the underside of the front sheet.

It will be appreciated that the number and arrangement of the blisters is equal to the number and arrangement of the openings in the two holder sheets. Thus the blister pack drops into the front sheet and matches the openings so that the blisters are exposed in front of the front sheet when the front sheet is closed to the position shown in FIG. 1. The rear sheet 32 has of course similarly arranged openings so that the foil layer on the rear of the blister pack is presented to the openings in the rear sheet 32. Raised ribs 31A on the face of the sheet 33 facing the sheet are provided surrounding each opening to assist in locating the blister pack as the punching action is effected.

A particularly preferred arrangement utilizes the layout of the blister pack as shown in the above Canadian patent where the blisters are arranged in a matrix of seven rows and four columns and in particular the first and fourth columns have the blisters thereof slightly larger in width than the blisters of the second and third columns. In this way a larger amount of medication can be contained within the first and fourth columns.

The manufacture of the holder 30 as a separate item from the container allows it to be snapped out of the container and replaced by an alternative holder. Such an alternative holder may utilize a different arrangement of blister pack with a different number of blisters and/or a different arrangement of blisters. In this way a large part of the dispensing container is generic and can be used with blister packs of different arrangements whereas the holder itself is shaped and designed to match a particular blister pack. The dimensions of the container and the dimensions of the holder are arranged so that they are sufficient to receive within the rectangular area presented blister packs of conventional sizes.

Behind the holder 30, the container portion 11 defines a chamber 40 which is generally rectangular and formed at its rear by the rear wall 23, at its front by the rear holder sheet 32, at its top by the top wall 19, at its sides by the side wall 20 and 21 and its bottom by the bottom wall 22. The chamber 40 has a sufficient width W so that medications expelled from the blisters by pushing on the blisters rearwardly can be received within the chamber 40. Thus the medications, regardless of which blister is depressed for expelling the medications, collects the medications within the chamber 40. Divider walls 23A are provided extending generally vertically and at right angles to the rear wall 23 toward the sheet 33 so as to act as guides for the medications expelled from the blisters to guide the medications downwardly to the bottom wall.

The bottom wall 22 of the chamber includes a central chute 41 with a bottom mouth 42. The chamber and the bottom wall are shaped so that any medications, regardless of the blister from where they came, fall to the bottom wall and then move by a shaping of the bottom wall into the chute 41 to collect at the mouth 42. Thus when the user depresses a blister, the medications are expelled and tumble to the bottom for collection at the mouth 42 of the chute.

The mouth 42 is closed by a flap 43 which extends across the mouth so that the medications at the mouth 42 fall onto the flap 43 and remain within the chute until the user is ready to receive the medications. The flap 43 is attached to a hinged lever 44 with a forwardly extending lower end 45 at the mouth 42. Thus the user can place a receptacle such as a cup against the bottom end of the lever and apply pressure to the lever so that it pivots rearwardly about a designed and integral hinge members 46 which pivots the flap 43 downwardly allowing the medications to be released from the mouth 42. The lever 45 is wider than the mouth 42 and has a central cupped area 47 tending to guide a circular edge of a receptacle such as a cup into the required position under the mouth 42. Thus the user, who may be infirm, can readily place the cup in the required position under the mouth 42 and can apply sufficient pressure flexing the lever and the flap about the hinge 46 to release the medications when the user is ready to receive those medications. The flap 43 and the lever 45 are preferably formed integrally, as a separate piece from the lower wall 22, from a memory plastics material so that it recovers to the closed position when the pressure by the user is released. The separate piece can be snap fit into the bottom wall at the top ends of the hinge pieces 46.

The user therefore has an extended period of time after the medications are punched from the blister to move to the next step in the process of picking up the cup or receptacle and moving it to the lever to release the medications from the chute 41. These actions can therefore be carried out as two separate steps with the user being able to concentrate initially on punching the required blister and only after this is carried out can concentrate upon collecting the medications for use.

A punch 50 is provided as a separate loose element having a handle 51 and a punching portion 52. The punching portion 52 has a front face 53 shaped to match the openings in the holding sheets and the blister pack so that the punch can be inserted into one of the openings and pushed forwardly to expel the material from the blister. The punch is a simple inexpensive item defined by the front face 53 and a side wall which extends rearwardly and outwardly in a slightly conical or pyramid shape so as to provide an effective punching action. The front face may therefore be slightly smaller than the openings, bearing in mind that some of the openings are smaller than others so that the punch face must match the smallest of the openings and thus may be significantly smaller than the largest of the openings. However the conical shape of the punch overcomes this problem by allowing the punch to pass through the blister and through the rear holding sheet slightly into the chamber 40 to ensure that the medications are punched through the foil layer and all the medications are expelled into the chamber 40.

The handle 51 is a simple flat strap which extends across the punch and can be grasped between the finger and thumb of the user to present the punch face at the openings in the blister pack. A receptacle 55 is provided for the punch so that it can be held in the container at the blister pack so that it is readily available for the punching action. In the embodiment shown the receptacle comprises a generally cylindrical opening having a shape matching the shape of the front face of the punch so that the front face can be dropped downwardly into the receptacle so that the expending side walls of the punch portion engage against the inside surface of the hollow or cylindrical receptacle leaving the handle readily exposed upwardly from the receptacle. Thus the user can simply lift the punch out of its holder, effect the punching action and immediately return the punch to its holder to be available for the next punching action.

As an alternative the punch may be simply suspended on a flexible string or elastic so that it is permanently held within the container and readily available to be pulled by the user to the required blister.

The punch therefore is an inexpensive item readily available at all times and thus avoids the difficulty of the user in punching using the tip or knuckle of a finger bearing in mind that the users tend to be infirm.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A dispensing container for use with a blister pack having a series of blisters each containing a dose of one or more medications which can be expelled from the blisters by a user for use of the medication, the dispensing container comprising:

a holder portion for receiving and supporting the blister pack;

the holder portion having a plurality of openings therein arranged to be aligned with the blisters in the blister pack such that the medication in each blister can be expelled from the blister through the opening;

a catching container for receiving the holder portion therein arranged such that medication expelled from the blisters through the openings is caught and held in the catching container;

a collecting chute with a bottom mouth at a bottom of the catching container arranged such that the medication caught and held in the catching container falls to the collecting chute and can be discharged by the user from the catching container through the bottom mouth when required;

a wall mounting arrangement arranged such that with the dispensing container mounted on a vertical wall surface the holder portion mounts the blister pack vertically with the catching container behind the blister pack and the collecting chute and bottom mouth at a bottom wall of the catching container;

the catching container including a front door panel hingedly attached thereto which can be moved from a closed position covering the holder portion and the blister pack therein so that the front door panel prevents the expelling of the medication with the front door panel in the closed position to an open position exposing the holder portion and the blister pack therein for expelling of the medication;

a valve flap at the bottom mouth arranged such that the medication is held by the valve flap in the catching container at the bottom mouth after being expelled until required;

the valve flap including a push lever portion extending beyond the bottom mouth which can be pushed by the user when required by the user to release the medication from the bottom mouth so as to fall downwardly from the bottom mouth to the user.

2. The dispensing container according to claim 1 wherein the wall mounting arrangement comprises a magnet for attachment to a metal surface and holes for attachment to mounting screws.

3. The dispensing container according to claim 1 wherein a front face of the front door panel has a photograph holder.

4. The dispensing container according to claim 1 including a punch having a front face shaped to match the openings in the holder portion for engaging through the holder portion and punching out the medications from the blisters, the punch having a manually graspable handle for manual movement of the punch to a selected one of the blisters and a support on the dispensing container to hold the punch on the dispensing container when not in use.

5. The dispensing container according to claim 4 wherein the support comprises a receptacle into which the punch is placed.

6. A dispensing container for use with a blister pack having a series of blisters each containing a dose of one or more medications which can be expelled from the blisters by a user for use of the medication, the dispensing container comprising:

a holder portion for receiving and supporting the blister pack;

the holder portion having a plurality of openings therein arranged to be aligned with the blisters in the blister pack such that the medication in each blister can be expelled from the blister through the opening;

wherein the holder portion comprises two generally planar sheets for receiving the blister pack therebetween which are connected by a hinge at one edge;

a catching container separate from the holder portion for receiving the holder portion carrying the blister pack in the catching container and arranged in the catching container such that medication expelled from the blisters through the openings is caught and held in the catching container;

a collecting chute with a bottom mouth at a bottom of the catching container arranged such that the medication caught and held in the catching container falls to the collecting chute and can be discharged by the user from the catching container through the bottom mouth when required;

a wall mounting arrangement arranged such that with the dispensing container mounted on a vertical wall surface the holder portion mounts the blister pack vertically with the catching container behind the blister pack and the collecting chute and bottom mouth at a bottom wall of the catching container;

the catching container including a front door panel hingedly attached thereto which can be moved from a closed position covering the holder portion and the blister pack therein so that the front door panel prevents the expelling of the medication with the front door panel in the closed position to an open position exposing the holder portion and the blister pack therein for expelling of the medication;

a valve flap at the collecting chute arranged such that the medication is held by the valve flap in the catching container after being expelled until required;

the valve flap being connected to a push lever extending beyond the bottom mouth which can be pushed by the user when required by the user to release the medication from the bottom mouth so as to fall downwardly from the bottom mouth to the user.

7. The dispensing container according to claim 6 wherein the wall mounting arrangement comprises a magnet for attachment to a metal surface and holes for attachment to mounting screws.

8. The dispensing container according to claim 6 wherein a front face of the front door panel has a photograph holder.

9. The dispensing container according to claim 6 including a punch having a front face shaped to match the openings in the holder portion for engaging through the holder portion and punching out the medications from the blisters, the punch having a manually graspable handle for manual movement of the punch to a selected one of the blisters and a support on the dispensing container to hold the punch on the dispensing container when not in use.

10. The dispensing container according to claim 9 wherein the support comprises a receptacle into which the punch is placed.

11. A dispensing container for use with a blister pack having a series of blisters each containing a dose of one or more medications which can be expelled from the blisters by a user for use of the medication, the dispensing container comprising:

a holder portion for receiving and supporting the blister pack;

the holder portion having a plurality of openings therein arranged to be aligned with the blisters in the blister pack such that the medication in each blister can be expelled from the blister through the opening;

a catching container arranged such that medication expelled from the blisters through the openings is caught and held in the catching container;

a collecting chute with a bottom mouth at a bottom of the catching container arranged such that the medication caught and held in the catching container falls to the collecting chute and can be discharged by the user from the catching container through the bottom mouth when required;

a wall mounting arrangement arranged such that with the dispensing container mounted on a vertical wall surface the holder portion mounts the blister pack vertically with the catching container behind the blister pack and the collecting chute and bottom mouth at a bottom wall of the catching container;

the catching container including a front door panel hingedly attached thereto which can be moved from a closed position covering the holder portion and the blister pack therein so that the front door panel prevents the expelling of the medication with the front door panel in the closed position to an open position exposing the holder portion and the blister pack therein for expelling of the medication;

a valve flap at the bottom mouth arranged such that the medication is held by the valve flap in the catching container at the bottom mouth after being expelled until required;

the valve flap including a push lever portion extending beyond the bottom mouth which can be pushed by the user when required by the user to release the medication from the bottom mouth so as to fall downwardly from the bottom mouth to the user;

the push lever portion of the being wider than the bottom mouth and having a central cupped area tending to guide an edge of a receptacle for receiving the medications into a required position under the bottom mouth.

12. The dispensing container according to claim 11 wherein the wall mounting arrangement comprises a magnet for attachment to a metal surface and holes for attachment to mounting screws.

13. The dispensing container according to claim 11 wherein a front face of the front door panel has a photograph holder.

14. The dispensing container according to claim 11 including a punch having a front face shaped to match the openings in the holder portion for engaging through the holder portion and punching out the medications from the blisters, the punch having a manually graspable handle for manual movement of the punch to a selected one of the blisters and a support on the dispensing container to hold the punch on the dispensing container when not in use.

15. The dispensing container according to claim 14 wherein the support comprises a receptacle into which the punch is placed.

* * * * *